US007374662B2

(12) United States Patent
Duplan et al.

(10) Patent No.: US 7,374,662 B2
(45) Date of Patent: May 20, 2008

(54) METHOD FOR JOINTLY PRODUCING PROPYLENE AND PETROL FROM A RELATIVELY HEAVY CHARGE

(75) Inventors: Jean-Luc Duplan, Irigny (FR); Sylvie Lacombe, Saint Genis Laval (FR); Jérôme Bayle, Lyons (FR); Vincent Coupard, Vaulx en Velin (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 506 days.

(21) Appl. No.: 10/507,847

(22) PCT Filed: Mar. 10, 2003

(86) PCT No.: PCT/FR03/00764

§ 371 (c)(1),
(2), (4) Date: Jan. 31, 2005

(87) PCT Pub. No.: WO03/078547

PCT Pub. Date: Sep. 25, 2003

(65) Prior Publication Data

US 2005/0121361 A1 Jun. 9, 2005

(30) Foreign Application Priority Data

Mar. 15, 2002 (FR) ..... 02 03212

(51) Int. Cl.

| | |
|---|---|
| ***C10G 11/00*** | (2006.01) |
| ***C10G 53/02*** | (2006.01) |
| ***C10G 65/12*** | (2006.01) |
| ***C10G 11/18*** | (2006.01) |
| ***C10G 1/00*** | (2006.01) |
| ***C10G 11/02*** | (2006.01) |
| ***C07C 1/00*** | (2006.01) |
| ***C07C 2/02*** | (2006.01) |
| ***C07C 4/02*** | (2006.01) |

(52) U.S. Cl. ..... 208/113; 208/61; 208/71; 208/81; 208/85; 208/118; 208/119; 585/310; 585/330; 585/502; 585/648; 585/649; 585/653

(58) Field of Classification Search ..... 208/61, 208/78, 81, 85, 113, 118, 119, 120, 71; 585/310, 585/330, 502, 648, 649, 653
See application file for complete search history.

(56) References Cited

U.S. PATENT DOCUMENTS 5,300,126 A * 4/1994 Brown et al. ..... 44/449

(Continued)

FOREIGN PATENT DOCUMENTS

EP 1061116 A1 * 12/2000

(Continued)

*Primary Examiner*—Walter D. Griffin
*Assistant Examiner*—Huy-Tram Nguyen
(74) *Attorney, Agent, or Firm*—Millen, White, Zelano & Branigan, P.C.

(57) ABSTRACT

A process for conversion of a hydrocarbon feedstock comprising a relatively heavy main feedstock with a boiling point above approximately 350° C., and a relatively light secondary feedstock with a boiling point below approximately 320° C., wherein, the main feedstock, representing at least 50 wt. % of the hydrocarbon feedstock, is cracked in a fluidized-bed reactor in the presence of a cracking catalyst, the secondary feedstock is cracked in a fluidized bed with the same cracking catalyst, separately or mixed with the main feedstock, said secondary feedstock comprising oligomers with at least 8 carbon atoms of light olefins with 4 and/or 5 carbon atoms.

19 Claims, 2 Drawing Sheets

U.S. PATENT DOCUMENTS

| | | | | | |
|---|---|---|---|---|---|
| 5,389,232 | A * | 2/1995 | Adewuyi et al. | ..... | 208/120.01 |
| 5,569,806 | A * | 10/1996 | Cameron et al. | ..... | 585/668 |
| 6,025,533 | A * | 2/2000 | Vora et al. | ..... | 585/330 |
| 6,080,903 | A * | 6/2000 | Stine et al. | ..... | 585/514 |
| 6,113,776 | A * | 9/2000 | Upson | ..... | 208/113 |
| 6,126,812 | A * | 10/2000 | Drake et al. | ..... | 208/134 |
| 6,342,200 | B1 * | 1/2002 | Rouleau et al. | ..... | 423/709 |
| 6,803,494 | B1 * | 10/2004 | Ladwig et al. | ..... | 585/653 |
| 6,835,863 | B2 * | 12/2004 | Chester et al. | ..... | 585/651 |
| 6,846,965 | B1 * | 1/2005 | Schulz et al. | ..... | 585/510 |
| 2003/0105248 | A1 * | 6/2003 | Cao et al. | ..... | 526/72 |

FOREIGN PATENT DOCUMENTS

| | | | |
|---|---|---|---|
| FR | 2663946 | * | 1/1992 |
| WO | WO 0149607 | | 7/2001 |

* cited by examiner

METHOD FOR JOINTLY PRODUCING PROPYLENE AND PETROL FROM A RELATIVELY HEAVY CHARGE

The present invention relates to a process for conversion of a hydrocarbon feedstock comprising for the most part a heavy fraction, in particular a vacuum distillate fraction, for the combined production of gasoline and propylene.

The demand for propylene has been increasing considerably for many years, with an annual growth rate practically a point higher than that of ethylene. There is therefore a need to increase the production of propylene. At present the principal source of production of propylene is the steam cracking of naphtha at yields comprised between approximately 13 and 17% depending on the severity. The other principal steam cracking feedstock, ethane, only produces a very small quantity of propylene. It should be noted moreover that the possibilities for controlling the course of steam cracking with a view to maximizing the propylene yield are relatively limited.

The other important source of production of propylene is catalytic cracking (generally known to the abbreviation FCC, which stands for Fluid Catalytic Cracking).

This process, which is carried out in a fluidized bed of catalyst, mainly produces gasoline from a feedstock of the vacuum distillate type, but also produces propylene, typically from 3 to 4%.

The catalytic cracking reactor (FCC) generally operates with ascending flow, and then mainly comprises a riser (a vertical pipe conveying the catalyst upwards with ascending circulation of the feedstock in co-current flow with the catalyst, wherein the chemical reaction takes place).

It can also sometimes operate with descending flow and comprise a dropper (a vertical tubular reactor with descending circulation of the feedstock in co-current flow with the catalyst). The reactor can also comprise a fluidized-bed vessel and not only an entrained-bed tubular reactor.

There is an implementation of catalytic cracking which as oriented towards the production of olefins and particularly of propylene. This implementation is based either on increasing the severity of the operating conditions, in particular an increase in the cracking temperatures, or on the use of relatively severe conditions combined with the use of specific additives to the cracking catalyst. Such catalytic additives (for example based on type ZSM-5 zeolite), which can be incorporated in the starting catalyst or introduced in the form of auxiliary catalyst, exhibit shape selectivity and tend at the same time to convert less reactive molecules with little branching, and to limit the reactions of hydrogen transfer which lead in particular to the formation of less reactive paraffins. Restricting the formation of paraffins helps to promote further cracking, including of medium-sized molecules.

All these conditions, thermal and/or catalytic, lead to notable cracking of compounds boiling in the distillation range of gasoline, which can also be recycled, at least partly, said cracking giving increased quantities of propylene.

This known orientation of catalytic cracking towards the production of propylene upsets the structure of the yields, with a drop in the gasoline yield, which can for example drop from approximately 50% to approximately 25% to the benefit of the C3-C4 cuts (where the term Cn designates a hydrocarbon cut having n carbon atoms), which can rise from 15% to practically 40%. This decrease in the quantity of gasoline produced is not generally desirable, as the market demand for gasoline is still high. This known orientation of the conventional catalytic cracker to a petrochemical cracker is therefore not a completely satisfactory response to the development of the market, characterized both by an increase in demand for propylene and a continuing demand for gasoline.

The process according to the invention aims to provide combined production of gasoline and propylene, mainly using a conventional heavy feedstock, but with improved propylene yields relative to conventional FCC, without a decrease, or with a smaller decrease, in the yield of gasoline.

Prior Art:

A prior art similar to the process according to the invention is catalytic cracking (FCC) of feedstocks of the vacuum distillate type in conditions of increased severity to increase the propylene yield, said increased severity being obtained, as mentioned, by severe thermal conditions and/or generally by adding certain catalytic additives to the base catalyst, for example zeolite ZSM-5.

Apart from catalytic cracking of heavy feedstocks, other patents belong to the prior art of the invention:

U.S. Pat. No. 6,049,017 describes a process for production of propylene and ethylene from a hydrocarbon cut containing olefins with C4 and higher number of carbons using a catalyst with small pore diameter (typically of the order of 5 Ångstrom). The examples given in this patent show that with a catalyst containing 40 wt. % of zeolite SAPO-34, the conversion of butenes to ethylene and propylene does not exceed 55% initially and decreases over time reaching in the best case 45% after 4.5 hours. Patent EP-A-1 061 116 describes a process for conversion of C4+ olefinic cuts to compounds mainly comprising propylene by adding a certain quantity of ethylene and hydrogen to the feedstock over a catalyst of the silicalite type. Patent WO-0104237 describes a process for conversion of hydrocarbon fractions ranging from C4 to C7, where said fractions can be olefinic and paraffinic, by means of a catalyst comprising a zeolite of the ZSM-5 or ZSM-11 type, and phosphorus. The operating conditions of catalytic cracking require reaction temperatures higher than those of a conventional catalytic cracking, from 510° C. to 704° C. being mentioned in the cited patent. The declared yields of propylene+ethylene range from 20 to 30% relative to the feedstock.

One of the advantages of the present invention is that it does not upset the course of catalytic cracking as in the majority of cases it maintains practically the same gasoline yield, which is still of the order of 35% to 55%, often from 40% to 50 wt. %, while in particular increasing the propylene yield, which can be comprised between 4 and 20 wt. %, often between 5 and 15 wt. %, and preferably between 7 and 12 wt. % relative to the total incoming (cracked) feedstock.

To this end the invention offers a process for conversion of a hydrocarbon feedstock, said feedstock comprising at least one relatively heavy main feedstock, i.e. made up of hydrocarbons with boiling point above approximately 350° C., and at least one relatively light secondary feedstock wherein the hydrocarbons have a boiling point below approximately 320° C., wherein,

- the main feedstock, representing at least 50 wt. % of the hydrocarbon feedstock, is cracked in at least one fluidized-bed reactor in the presence of a cracking catalyst,
- the secondary feedstock is cracked in a fluidized bed with the same cracking catalyst, separately or mixed with the main feedstock, said secondary feedstock comprising olefins with at least 8 carbon atoms which were produced by oligomerization of light olefins with 4 and/or 5 carbon atoms, the effluents from cracking of the main feedstock and of the secondary feedstock are fractionated in a common fractionation zone, and the catalyst used for cracking the main feedstock and that used for cracking the secondary feedstock are regenerated in a common regeneration zone.

The relatively light secondary feedstock can also comprise, apart from the oligomers of C4 and/or C5 olefins, other light fractions with boiling point below 320° C., such as recycled gasoline (gasoline from FCC), and/or other olefinic gasolines (i.e. comprising olefins), for example gasoline from visbreaking or from coking or synthesis gasoline produced by the Fischer-Tropsch process. It can also comprise oligomers formed from compounds other than C4 and/or C5 olefins, for example formed from other olefins of the group of olefins with C2, and C6 to C10 or more, or oligomers formed by co-oligomerization of olefins.

The secondary feedstock can also comprise light compounds (such as C2 to C10 paraffins and/or light olefins) and/or aromatics (for example C6 to C10), which may optionally be present in an effluent from oligomerization of light olefins. It can also comprise other compounds or fractions, for example recycled light gasoil.

The hydrocarbon feedstock (total feedstock used as feed for catalytic cracking) can optionally comprise, apart from the main feedstock and the secondary feedstock, other compounds such as heavier oligomers boiling above 320° C., or gasoil fractions (from direct distillation or from recycling from catalytic cracking or from other conversion units, for example fractions boiling between 320 and 350° C.

The C4/C5 and more generally C2 to C10 olefins which are the source of the oligomers can have various origins: Fluidized-bed catalytic cracking (FCC) also produces, apart from gasoline and heavier products, a C4 hydrocarbon cut comprising mainly isobutane, isobutene, n-butenes and butanes accompanied by small quantities of butadiene-1,3 and acetylenic hydrocarbons and, in the gasoline fraction, a C5 hydrocarbon cut which mainly comprises pentanes, methylbutenes and n-pentenes, accompanied by small quantities of C5 diolefins and acetylenic hydrocarbons.

Furthermore, steam cracking of feedstocks comprising light cuts, mainly paraffinic, for example naphtha, supplies ethylene and propylene which are required for the petrochemicals industry. It also supplies a certain number of other heavier products, and in particular a C4/C5 hydrocarbon cut (with 4 and/or 5 carbon atoms) which mainly comprises, for the C4 cut, butadiene-1,3, isobutene, n-butenes and butanes, and for the C5 fraction, methylbutenes, n-pentene, pentane and C5 diolefins. Another cut which as often available in considerable quantity is raffinate 1, i.e. the C4 fraction, after extraction of butadiene.

The light C4 and C5 cuts from steam cracking and from FCC, available in copious quantities, thus comprise notable quantities of light olefins, often more than 30%, and sometimes up to nearly 80 wt. % or more after selective hydrogenation of certain butadiene-rich cuts.

However, these fractions can scarcely be recycled to the FCC to increase the propylene yield, as they have very low reactivity in the conditions of FCC, which are adapted to the vacuum distillate feedstock.

The invention proposes a process for valorizing these light fractions after their at least partial conversion to longer olefins, it being possible for said conversion to be carried out by the process according to the invention itself, or independently of this process. These longer olefins (oligomers), which are much more reactive, are good precursors of propylene, used in the process according to the invention as a supplement to the main feedstock to increase the propylene yield, without having an adverse effect on the production of gasoline, or to a lesser extent, for a given production of propylene, if cracking conditions are nevertheless used, which are more severe and/or a special additive or a catalyst for deeper cracking, as has already been mentioned.

According to the invention, the hydrocarbon feedstock, or total feedstock cracked: main feedstock+secondary feedstock+optionally another supplementary feedstock, comprises more than 50 wt. % of hydrocarbons boiling above 350° C., generally from vacuum distillate, or optionally from atmospheric residue. Often the hydrocarbon feedstock comprises more than 60 wt. % of hydrocarbons boiling above 350° C., and most often more than 70 wt. %, for example between 70 and 95 wt. %.

The secondary feedstock typically comprises at least 1 wt. %, generally at least 2 wt. %, in particular from 2 to 40 wt. %, relative to the hydrocarbon feedstock (total feedstock used as feed for catalytic cracking), of olefins with at least 8 carbon atoms which were produced by oligomerization of light olefins with 4 and/or 5 carbon atoms, often from 3 to 35 wt. %, and most often from 4 to 30 wt. %, in particular from 6 to 25 wt. %.

The feedstock can also comprise other oligomers formed essentially from the group comprising C2 to C10 olefins. The secondary feedstock then typically comprises from 2 to 45 wt. %, often from 3 to 38 wt. %, and most often from 4 to 33 wt. %, in particular from 6 to 28 wt. % relative to the hydrocarbon feedstock (total feedstock used as feed for catalytic cracking) of olefins with at least 6 carbon atoms which were produced by oligomerization of light olefins from the group comprising the C2 to C10 olefins. The C6 oligomers, formed in particular by addition of ethylene to a butene, or the heavier oligomers formed at least partly from olefins with C6 or more (C6+) are in fact also good precursors of propylene, which it is also advantageous to use as feed for catalytic cracking.

According to the invention, the cracking catalyst is the same for the main feedstock and the secondary feedstock, regardless of whether these two feedstocks are cracked as a mixture, after introduction into the reactor at the same point or at separate points, or whether they are cracked separately.

In the first case, the two feedstocks: relatively heavy main feedstock and relatively light secondary feedstock, can be cracked as a mixture in the same FCC cracking unit, typically in the same practically vertical tubular riser. They can be introduced as a mixture, generally at a single level of the riser, or separately, for example at two different levels. In particular, the secondary feedstock comprising mainly C8 olefins, produced by oligomerization, can be fed at the bottom of a riser, and the relatively heavy main feedstock can be introduced at a higher level. This makes it possible to crack the secondary feedstock with greater severity than the main feedstock, in particular with a higher temperature of the start of cracking (immediately after mixing with the catalyst), for example approximately 10-200° C. higher than that of the start of cracking of the main feedstock.

In the second case: main and secondary feedstocks cracked separately, the relatively heavy main feedstock is cracked in a first practically vertical tubular riser and the relatively light secondary feedstock is cracked separately in a second practically vertical tubular riser.

The catalyst, regenerated in a common regeneration zone, is divided after regeneration, into two parts feeding the two separate tubular risers in parallel. The catalyst is therefore the same, i.e. of the same type, even if each reactor is fed with its own particular flow of catalyst. The flows of used catalyst leaving the two reactors are moreover separated from the cracking effluents and are regenerated as a mixture, which means that the two flows of catalyst are only differentiated transiently.

In the second case, the cracking temperature (outlet temperature of the cracking zone) of the relatively light secondary feedstock can preferably be approximately 10 to 120° C., more preferably approximately 20 to 80° C. and very preferably approximately 20 to 50° C. higher than the cracking temperature of the relatively heavy main feedstock. It is, however, also possible to use a similar temperature for the two feedstocks.

If the total hydrocarbon feedstock comprises an additional fraction boiling in the range 320-350° C., said additional fraction can be cracked with the main feedstock or with the secondary feedstock, or distributed as a mixture with these two feedstocks.

The cut-off point between two separate feeds of feedstock can also be different from the zone 320-350° C.: For example, a cut boiling below 220° C., or with 90% distilled point of approximately 220° C., can be cracked with greater severity, and the heavier fractions, for example a vacuum distillate, optionally with addition of light or heavy recycled gasoil, can be cracked at lower severity.

According to one of the preferred variants of the process according to the invention, the process incorporates the manufacture of oligomers: then a feedstock comprising olefins with 4 and/or 5 carbon atoms by oligomerization is converted in at least one stage, in at least one oligomerization reactor, using, as secondary feedstock for catalytic cracking, a feedstock comprising a part at least, generally mostly, olefins with at least 8 carbon atoms contained in the effluents from oligomerization.

It was found moreover that prior oligomerization of a feedstock comprising both C4 olefins and at least a notable quantity of other olefins of the group comprising C2, C5 and C6 olefins, in particular C5 and/or C6, led to increased yields and better selectivity for propylene.

The oligomerization feedstock can in particular comprise from 0.5 to 15 wt. % of ethylene, and in particular from 0.5 to 15 wt. % of ethylene relative to the sum of the C4, C5 and C6 olefins. This makes it possible to valorize the small quantities of ethylene available from an FCC unit.

In particular, an oligomerization (probably with partial co-oligomerization) of a mixture comprising C4 and C5, or C4 and C5 and C6, or C4 and C2 and C5, or C4 and C2 and C5 and C6 olefins, leads to improved propylene yields (after cracking), to greater conversion, and to operating conditions which are easier to implement, than if only the C4 cut were oligomerized, the C5 olefins in particular being cracked without prior oligomerization. The advantage of this co-oligomerization is notable when the quantity of C5 fraction oligomerized is sufficient.

Among the preferred feedstocks of the process according to the invention, which are used as feed for oligomerization, we find feedstocks comprising at least 50 wt. % and often at least 70 wt. % or even more of C4+C5+C6 fractions, and which comprise olefins of at least two of the fractions C4, C5, and C6, and in particular a feedstock:

comprising an olefinic C4 cut (i.e. comprising olefins, optionally with other compounds, for example paraffins), the feedstock comprising for example at least 10 wt. % of C4 olefins, and also comprising C5 and/or C6 olefins, for example at least 10 wt. %, with a mass ratio:

R1=C5 Olefins+C6 Olefins/C4 Olefins which is greater than 0.15 and for example $0.2<R1<5$ in particular $0.3<R1<3$ and in particular $0.5<R1<2$ and more particularly $0.7<R1<1.5$.

or comprising an olefinic C4 cut, the feedstock comprising for example at least 10 wt. % of C4 olefins, and also comprising C5 olefins, for example at least 10 wt. %, with a mass ratio:

R2=C5 Olefins/C4 Olefins greater than 0.15 and for example $0.2<R2<5$ in particular $0.3<R2<3$, in particular $0.5<R2<2$ and more particularly $0.7<R2<1.5$.

These feedstocks comprising C4 and C5 olefins can also comprise C6 olefins; they can also be practically free from C6 olefins, with for example a mass ratio:

R3=C4 Olefins+C5 Olefins/C6 Olefins greater than 10, the C6 olefins being optionally sent for example to the cracking stage, mixed with the oligomers, without being subjected to prior oligomerization.

These feedstocks give very good propylene yields, after oligomerization and cracking according to the process of the invention. It is thought that the C4 and C5 olefins, in particular the fractions of C9 co-dimers, resulting from dimerization of a butene and of a pentene give better propylene yields and a higher propylene/ethylene ratio than by direct cracking of C4 or C5 olefins, in particular because a notable fraction of C9 dimer can crack giving 3 molecules of propylene.

The fractions resulting from catalytic cracking (FCC) typically contain olefinic C4 and C5 cuts which can be recycled. It is, however, possible according to the invention to use as feed for oligomerization, external olefinic fractions, of fresh feedstock, i.e. not received from the effluents of the fluidized-bed cracking (FCC) stage according to the invention, for example feedstocks received from another FCC and/or from one or more steam crackers (cracking naphtha for example).

The oligomerization reactor and the fluidized-bed catalytic cracking reactor are separate in the process according to the invention, and operate with different operating conditions, making it possible to choose optimum conditions for each type of chemical reactions.

Preferably, the effluents from catalytic cracking are fractionated in particular to produce a cut, generally light, comprising olefins with 4 and/or 5 carbon atoms, and a part at least of this cut is recycled to oligomerization.

According to another preferred variant of the process according to the invention, the feedstock of oligomers is not manufactured by the process (in particular as intermediate), but is supplied from an external source.

The feedstock sent for oligomerization can be subjected, if necessary, to a selective hydrogenation for practically eliminating any diolefinic and/or acetylenic compounds which are present. The raw C4/C5 fractions obtained from a steam cracker contain a quantity of diolefins such that a selective hydrogenation is very strongly recommended. Even in the case of a raw C4/C5 fraction obtained from the FCC itself, it is generally preferable to carry out said selective hydrogenation to give a notable increase in the cycle time of oligomerization.

Selective hydrogenation also makes it possible to increase the quantity of olefins, by converting diolefins and acetylenics to mono-olefins.

When a gasoline fraction is also used as feed for the FCC, said fraction can also be subjected to a selective hydrogenation, jointly or separately from that of the C4 and/or C5 cut. When this selective hydrogenation is carried out jointly, the gasoline can optionally be separated from the C4 and/or C5 cut upstream of oligomerization.

All of the oligomers produced in oligomerization (C8+ fraction of the effluents from oligomerization) can be sent to the FCC.

Another possibility is not to send all of the oligomers produced to the FCC, but to reserve a part thereof, for example from 10 to 50 wt. %, for other petrochemical applications (for example it is possible to separate and evacuate a fraction mainly comprising olefins having from 10 to 14 carbon atoms, which can be used as a base for a feedstock for alkylation by benzene for the preparation of alkylbenzenes, or as bases for other chemical or petrochemical applications). It is also possible to separate, from the effluents from oligomerization or from at least one stage of oligomerization if there are several stages, and evacuate directly (i.e. without subjecting it to cracking) one or more fractions boiling in the distillation range of gasoline, of kerosene, or gasoil or of domestic heating oil, which can be used as bases for the manufacture of these products, or a mixture of these fractions. In particular it is possible to separate a fraction comprising di-isobutene and/or tri-isobutene, for example a C8 or C8+ fraction, said fraction being separated and evacuated, therefore not used as feed for the FCC, to avoid its notable re-cracking to isobutene. The fraction of oligomers separated in order to be evacuated can be obtained by fractionation of the effluents from at least one oligomerization stage, in particular by one or more distillations. It is also possible simply to take off and evacuate a part of the effluents from oligomerization, without distillation. The take-off of a fraction of effluents from oligomerization comprising oligomers, or a fraction of the oligomers, with a view to its direct evacuation, can be regarded according to the invention as being similar to an operation of separation or of fractionation of the effluent from oligomerization or of the oligomers.

The propylene yield, relative to the quantity of hydrocarbons boiling above 350° C., is generally at least 4 wt. %, for example between 4 and 20 wt. %, often between 5 and 15 wt. %, and for example between 7 and 12 wt. %. The gasoline yield, relative to the quantity of hydrocarbons boiling above 350° C., is generally comprised between 35 and 55 wt. %, and for example between 40 and 50 wt. %.

In a typical version, the process according to the invention proposes a sequence of reaction stages: selective hydrogenation, oligomerization, and catalytic cracking (FCC with a mixed feedstock or two separate feedstocks), and each stage can be optimized from the standpoint of the operating conditions and of the catalyst used. The various units for selective hydrogenation, oligomerization and catalytic cracking used in the present invention are then present at the same refining site. Alternatively, selective hydrogenation, or selective hydrogenation and oligomerization, can be carried out externally, for example at a steam cracking site.

In most cases the operating conditions of catalytic cracking are not vastly different from those of conventional catalytic cracking, and the catalytic cracker can continue to operate simultaneously with its traditional main feedstock of the vacuum distillate or atmospheric residue type, as well as with a supplementary feedstock of propylene precursor oligomers.

The catalytic cracker can also continue to produce large quantities of gasoline, since the increase in the production of propylene mainly results from cracking of the oligomers, and not from secondary cracking of the gasoline.

It is, however, possible to use cracking conditions which have been made more severe (thermally or by adding additives to the catalyst for example of the ZSM-5 type) so that production of propylene is promoted to the maximum.

It is also possible for the catalytic cracker to have supplementary feed of gasoline fractions containing a notable fraction of olefins, in particular of gasoline of relatively low octane number, such as for example gasoline from a visbreaking or coking unit, or recycled FCC gasoline. It may in fact be desirable to promote a high propylene yield relative to the gasoline yield. In certain economic situations there may also be lower demand for gasoline. In all cases, however, the presence of the feedstock of oligomers permits a gain in propylene, or ensures, at constant production of propylene, that there is less adverse effect on the gasoline yield than in the prior art, or said yield is maintained.

The particular conditions of the various reaction stages of the process according to the invention are described in more detail below, in its most integrated variant (selective hydrogenation+oligomerization+FCC on the same site), carried out using a main feedstock of vacuum distillate and a light cut of C4 and C5 hydrocarbons comprising butenes, pentenes, butanes, pentanes as well as butadiene and pentadiene in variable quantities.

1) Selective Hydrogenation (Stage a):

The light cut comes typically from a steam cracker and/or the effluents from the FCC (from separation of the effluents from the catalytic cracking stage of the heavy feedstock and of the light feedstock). The contents of dienes (diolefins) and acetylenics are high when this cut comes from a steam cracker; that is why a Stage a) of selective hydrogenation of the dienes and acetylenics to mono-olefins is almost indispensable in this case. It is also preferable in the majority of cases, as it reduces the coking of the oligomerization catalyst in Stage b), and increases the cycle time of the oligomerization reactor. However, the scope of the invention would not be exceeded if such a stage of selective hydrogenation were not included in the process according to the invention.

The main aim of this first stage is to convert the diolefins (or dienes) to mono-olefins. In fact, the mono-olefins are the source of the oligomers produced in Stage 2. It is therefore desirable to convert the diolefins to mono-olefins. The second aim of this stage is to remove the traces of acetylenic hydrocarbons which are present in these fractions and are undesirable compounds for oligomerization, these compounds also being converted to mono-olefins. The residual content of acetylenics can even be below 10 ppm, or 5 ppm or even 1 ppm by weight.

When there is a high part of diolefins in the cut, the conversion can be carried out advantageously in two or three reactors in series for better control of the selectivity of hydrogenation. Often the feedstock to be treated by recycling is diluted with a certain quantity of the effluent from this selective hydrogenation.

The residual content of diolefins+acetylenics of the effluent from selective hydrogenation is typically less than approximately 1000 ppm by weight, preferably less than approximately 100 ppm by weight and very preferably less than 20 ppm by weight.

The quantity of hydrogen required for all of the reactions carried out in this stage is generally adjusted as a function of the composition of the fraction so as to have advantageously just a slight excess of hydrogen relative to the stoichiometric.

Generally, this stage of selective hydrogenation is carried out using a catalyst comprising at least one metal selected from the group formed by nickel, palladium, and platinum, deposited on a support comprising alumina, silica or silica-alumina. Preferably a catalyst is used that comprises at least palladium or a palladium compound fixed on a refractory mineral support, for example on an alumina or a silica-alumina. The content of palladium on the support can be typically from 0.01 to 5 wt. %, preferably from 0.05 to 1 wt. %. Various forms of pretreatment known to a person skilled in the art can optionally be applied to these catalysts to improve their hydrogenation selectivity towards the mono-olefins.

The operating temperature of selective hydrogenation is generally comprised between 0 and 200° C., the pressure is typically comprised between 0.1 and 5 MPa, often between 0.5 and 5 MPa, the space velocity is typically comprised between 0.5 and 20 $m^3$ per hour per $m^3$ of catalyst, often between 0.5 and 5 $m^3$ per hour per $m^3$ of catalyst, and the molar ratio H2/(acetylenic+diolefinic compounds) is generally comprised between 0.5 and 5 and preferably between 1 and 3.

When a gasoline cut is also used as the feed for catalytic cracking, this cut can also be subjected beforehand to selective hydrogenation, jointly with or separate from that of the C4 and/or C5 cut. When this selective hydrogenation is carried out jointly, the gasoline can optionally be separated from the C4 and/or C5 cut upstream of the oligomerization.

Selective hydrogenation is generally carried out using a fixed-bed reactor, with descending co-current flow of the feedstock to be treated and of the hydrogen (or a gas containing a notable molar fraction of hydrogen, for example at least 50%), or with descending flow for the feedstock to be treated and ascending flow for the hydrogen.

The process of the invention can also comprise one or more optional stages of purification of the feedstock (separately from or jointly with the selective hydrogenation) upstream of the oligomerization, which may be useful or necessary for at least one of the following stages: oligomerization and cracking. The usefulness of these optional stages of purification is directly dependent on the catalyst or catalysts used as well as on the operating conditions and will be obvious to a person skilled in the art for each particular case considered. Thus, the scope of the invention would not be exceeded if, upstream of the oligomerization, one or more stages of desulphuration, and/or drying, and/or denitrogenation, and/or deoxygenation were carried out, to remove one or more of the following impurities: sulphur, water, nitrogen, oxygen, below 100 ppm, or 10 ppm, or even 1 ppm by weight, in accordance with conventional techniques.

2) Oligomerization (Stage b), or b1), or b3)):

The aim of this stage (or of these stages) is to oligomerize the linear, and optionally branched, C4 and C5 olefins, as well as any other olefins present, for example and non-limitatively C2 olefins (ethylene) and/or C6 olefins (hexenes) or even heavier, resulting from the preceding stage, to obtain a mixture of hydrocarbons containing mono-olefins with a number of carbon atoms for the most part greater than or equal to eight. Typically, starting from a C4 feedstock, oligomers are obtained wherein the number of carbon atoms is to a large extent at least less than or equal to 30, and for the most part comprised between 8 and 20.

According to the invention, and in the present description as well as in the claims, the term oligomers (and the terms oligomerize and oligomerization) are used more widely, applying it to higher olefins formed by addition of n identical and/or different olefins (the term thus also applying to a fraction comprising co-oligomers).

Oligomerization differs from polymerization by addition of molecules in limited number, the aforementioned figure n being, for the most part by weight at least oligomers, between 2 and 10, inclusive, and generally between 2 and 5, in particular between 2 and 4. The oligomers may however comprise traces of olefins which have been oligomerized with n>10. In most cases these traces represent less than 5 wt. % relative to the oligomers formed.

Oligomerization can be carried out in one or more stages, with one or more reactors and one or more catalysts. The following description of the catalyst and of the operating conditions can apply to any one of the stages and/or to any one of the reactors.

The oligomerization stage can use a catalyst comprising a Lewis acid, for example aluminium chloride, a chloroalkylaluminium, tin tetrachloride, boron trifluoride, said Lewis acid often being combined with traces of hydrochloric acid, water, tert-butyl chloride, or organic acids. The selectivities for dimer and for trimer depend on the catalyst and on the operating conditions. In the present invention, the process for oligomerization is such that a notable or if necessary thorough conversion of all of the starting olefins is sought.

The catalyst used for the oligomerization stage can also comprise supported sulphuric acid or supported phosphoric acid, for example on silica, alumina, or silica-alumina.

The catalyst used for the oligomerization stage can also comprise a sulphonic resin (as a non-limiting example, an AMBERLIST resin marketed by the company ROHM & HAAS).

The catalyst used for the oligomerization stage can also comprise a silica-alumina, or preferably an acidic solid exhibiting shape selectivity.

For example, said catalyst can comprise at least one zeolite exhibiting shape selectivity, said zeolite comprising silicon and at least one element chosen from the group comprising aluminium, iron, gallium, phosphorus, boron, and preferably aluminium. Said zeolite exhibiting shape selectivity can for example be of one of the following structural types: MEL (for example ZSM-11), MFI (for example ZSM-5), NES, EUO, FER, CHA (for example SAPO-34), MFS, MWW, or can also be one of the following zeolites: NU-85, NU-86, NU-88 and IM-5, which also exhibit shape selectivity.

The advantage of these zeolites which exhibit shape selectivity is that it limits the formation of highly branched oligomers, for example tri-branched isomers, cracking of which leads to a lower propylene/isobutene selectivity, i.e. to a lower propylene/isobutene mass ratio.

It is also possible to use several zeolites, for example a type MR zeolite (for example ZSM-5) combined with another zeolite exhibiting shape selectivity, previously mentioned or of one of the types previously mentioned.

The zeolite used can also be mixed with a zeolite which does not exhibit shape selectivity, for example a zeolite Y of structural type FAU.

The zeolite or zeolites can be dispersed in a matrix based on silica, alumina or silica-alumina, the part of zeolite (and generally of zeolite exhibiting shape selectivity) often-being comprised between 3 and 80 wt. %, in particular between 6 and 50 wt. % and preferably between 10 and 45 wt. %.

The zeolite used (or the zeolites used) exhibiting shape selectivity generally have an Si/Al ratio greater than 12, preferably greater than 20, more preferably greater than 40, and even more preferably greater than 80.

The aforementioned Si/Al ratio can for example be comprised between 40 and 1000. This makes it possible to reduce the acidity of the catalyst and the reactions of hydrogen transfer which lead to the formation of paraffins having little or no reactivity in the subsequent cracking stage. These high Si/Al ratios can be obtained at the time of manufacture of the zeolite, or by subsequent dealumination.

The oligomerization catalyst can finally be different from the aforementioned catalysts, if it possesses notable activity in oligomerization.

The oligomerization catalyst can be used in the solid state, in powder form for use in a fluidized bed, with continuous circulation of the catalyst from the reactor to a regeneration zone.

It can also be used in the form of spheres or extrudates with diameter generally comprised between 0.4 and 6 mm, and preferably between 0.6 and 4 mm, for use in a fixed bed. The catalyst can then be regenerated at spaced intervals of time. According to another embodiment, at least 2 fixed-bed reactors with cyclic operation are used, one reactor being in operation (oligomerization phase) and another reactor in the regeneration phase, according to the "swing" reactor technique, using the English term which as well known to a person skilled in the art. When the regeneration of the second reactor is finished, the feedstock is swung to the second reactor, and the catalyst of the first reactor is regenerated. It is also possible to use three reactors, with two reactors in operation and one in regeneration, or three reactors in operation and one in regeneration, or N reactors in operation and P reactors in regeneration, variants which are also regarded as equivalent to swing reactors.

The regeneration phase typically comprises a phase of combustion of the carbon deposits formed on the catalyst, for example by means of an air/nitrogen mixture or of air with lower oxygen content (for example by recirculation of fumes), or of air, and can optionally comprise other phases of treatment and of catalyst regeneration.

It is also possible to use a moving bed of small spheres generally with diameter comprised between 0.4 and 6 mm, and preferably between 1 and 3 mm, with continuous or semi-continuous circulation of the catalyst from the reactor to a regeneration zone.

The oligomerization catalyst can also be used in the form of a suspension in a saturated hydrocarbon such as hexane or isobutane, or in a halogenated hydrocarbon such as methyl chloride. The suspension can be used in a bubbling bed, in particular with particles with average diameter comprised between 0.25 and 1 mm and preferably between 0.3 and 0.8 mm, or in fine suspension, with particles of average diameter comprised between 0.02 and 0.25 mm and preferably between 0.03 and 0.20 mm. It is also possible to use a suspension where the particles are in the colloidal state.

The preferred form of application for the oligomerization reactor is fixed-bed.

The operating conditions are chosen as a function of the catalyst, in such a way that the reaction takes place at a sufficient rate. The temperature (at reactor outlet) can be for example comprised between −100° C. and 350° C., preferably between 70° C. and 310° C., and very preferably between 70° C. and 250° C., for example between 120° C. and 250° C., in particular between 150 and 220° C. Often the temperature of the oligomerization stage b) is at least 40° C. lower, preferably at least 80° C. lower, and very preferably at least 120° C. lower than that of the catalytic cracking stage d).

The pressure is typically comprised between 0.1 and 10 MPa, and preferably between 0.1 and 5 MPa, and very preferably between 0.8 and 4 MPa, and in particular between 1.5 and 3.5 MPa. Often the pressure (at reactor outlet) of the oligomerization stage b) is at least 0.5 MPa higher, preferably at least 1 MPa higher, and very preferably at least 1.5 MPa higher than that of the catalytic cracking stage d).

The HSV is generally comprised between 0.1 and 5 $m^3$ per hour per $m^3$ of catalyst, and preferably between 0.5 and 4 $m^3$ per hour per $m^3$ of catalyst.

The operating conditions are often also optimized as a function of the characteristics of the feedstock.

It is also possible to use, for the selective hydrogenation stage and for the oligomerization stage, conditions which are similar, and in particular pressures which are similar, such as pressures that only differ from one another by 0.5 MPa at most, or even 0.3 MPa at most. This makes it possible for the two reactions to follow one another, optionally without intermediate fractionation or pressurization or depressurization, or optionally even without intermediate cooling or even without intermediate heating. It is also possible to carry out the reactions of selective hydrogenation and of oligomerization in two successive beds of one and the same reactor.

The conversion of the C4 and C5 olefins during oligomerization generally reaches 90% or more, and can even be practically total.

It may be useful in this stage, in the particular conditions discussed below, to add a small quantity of ethylene to the feedstock as this promotes the formation of oligomers with six or seven carbon atoms (by addition with the C4/C5 olefins of the feedstock) and their subsequent cracking to propylene. This makes it possible to valorize the relatively limited quantities of ethylene produced in the FCC. Another situation where this arrangement is useful is that of an ethylene supply from a steam cracker, during economic conditions when there is low demand for ethylene but the demand for propylene remains high. The quantity of ethylene can then be adjusted to the available surplus. (For comparison, such adjustment is not possible in the process with metathesis, where as many moles of ethylene are used as of butene). The quantity of ethylene which can be used is for example comprised between 0.5 and 15 wt. % of the oligomerization feedstock.

The use of oligomerization at relatively high pressure and low temperature relative to that of catalytic cracking makes it possible to optimize the two types of chemical reactions separately, and to use specific catalysts.

Generally, the oligomerization reactor is a fixed bed, uses a catalyst comprising a silica-alumina or preferably at least one zeolite, and very preferably a zeolite exhibiting shape selectivity (for example a type MFI zeolite), and operates at a temperature comprised between 70° C. and +310° C., a pressure typically comprised between 0.1 and 5 MPa, and a space velocity comprised between 0.1 and 5 $m^3$ per hour per $m^3$ of catalyst.

According to a variant of the process according to the invention, which can be used in particular when the feedstock contains large quantities of isobutene, the oligomerization stage can be carried out in 3 stages:

- A first Stage b1) of limited oligomerization, making it possible to carry out preferential oligomerization of the more reactive branched olefins, in particular of isobutene, the linear olefins being in particular less oligomerized,
- A Stage b2) of fractionation of the effluents from Stage b1), for example by distillation or any other known fractionation, making it possible to extract a cut comprising di-isobutene and/or tri-isobutene: C8 cut rich in di-isobutene, and/or in tri-isobutene, or practically pure di-isobutene, or optionally a C8+ fraction (C8 and heavier), said extracted fraction comprising di-isobutene and/or tri-isobutene not being used as feed for the cracking stage d).

A Stage b3) of final oligomerization of the effluent from Stage b1), or at least of olefinic C4 and/or C5 fractions from said effluent, after extraction of the aforementioned cut comprising di-isobutene and/or tri-isobutene.

These stages interact with one another as well as with the catalytic cracking stage: Stages b1) and b2) make it possible to remove at least partly the isobutene via a product: di-isobutene and/or tri-isobutene for which the catalytic cracking propylene yields are relatively low, and obtain less-branched oligomers in Stage b3), giving better cracking yields. The at least partial removal of isobutene before Stage b3) also makes it possible to limit gum formation during said Stage b3), for which deep oligomerization of the remaining olefins is required, in particular of the linear C4 and/or C5 olefins.

The variant of the process described above (with limited oligomerization b1) then final oligomerization b3) after fractionation b2) and at least partial removal of the oligomers formed in b1)) can also be applied to a feedstock comprising isoamylenes (branched C5 olefins) instead of isobutene, or a feedstock comprising isobutene and isoamylenes. These branched olefins can be oligomerized much more easily and preferentially to their linear homologues, which makes it possible to evacuate them at least partially after Stage b1).

Stage b1), which does not aim at the formation of linear olefins which are good precursors of propylene, can be implemented with a catalyst among those mentioned previously, but also with a zeolite catalyst having a percentage of zeolite exhibiting shape selectivity lower than that of Stage b3), or even with a non-zeolite catalyst, essentially comprising an amorphous silica-alumina of medium acidity. It is also possible to use operating conditions which are different (from those of b3)), and are very selective as it provides very preferential or exclusive isomerization of the isobutene (and/or of the isoamylenes) relative to the n-butenes (linear butenes) and/or the n-pentenes. For example, it will be possible to use milder conditions in the first stage of oligomerization relative to the final stage, in particular by using a temperature at least 40° C. lower in the first stage. It is for example possible to carry out a first oligomerization b1) with a temperature comprised between 20 and 80° C., and a second oligomerization b3) with a temperature above 100° C., or even 120° C. or more. It is possible to use the same catalyst for b3), for example based on silica-alumina, or alternatively different catalysts.

Di-isobutene and tri-isobutene are in fact, for each of these compounds, a mixture of isomers, well known to a person skilled in the art; in particular there are two isomers for di-isobutene, including 2,4,4-trimethyl-2-pentene, with normal boiling point of 104.9° C., which boils in the gasoline range and has a good octane number. Tri-isobutene comprises oligomers certain of which have a normal boiling point comprised between 196 and 210° C., which can be incorporated at least partly in a gasoline base or a kerosene, or a gasoil, depending on the valorizations required. It can also be valorized for uses in the chemical industry.

An extracted cut rich in di-isobutene can be valorized at a high level as gasoline base, or for other uses, for example in the chemical industry etc.

Typically, a part at least of the said cut (or part) evacuated comprising di-isobutene is added to a part at least of the gasoline produced directly by cracking, to produce a gasoline base. The conditions of the oligomerization stage can be determined, for example by limiting the conversion in Stage b) or in Stage b1), for which said cut (or part) evacuated comprising di-isobutene makes it possible, after at least partial addition to at least a part of the gasoline produced directly by cracking, to increase the motor octane number and/or research octane number of this cracked gasoline. The aforementioned restriction of the conversion of the oligomerization stage (for example b1)) makes it possible to obtain an increased quantity of di-isobutene, which is very reactive relative to the linear pentenes.

Stage b1) can be implemented on a C4 cut alone, and a C5 cut, or C2 and C5 in particular can optionally be added to the butenes not converted in b1) for final oligomerization in Stage b3). It is also possible to carry out Stage b1) with a feedstock comprising hydrocarbons other than a C4 cut, for example an olefinic cut with C4 and C5, or C4 and C5 and C6, or C4 and C2 or C4 and C2 and C5, or C4 and C2 and C5 and C6.

It is also possible for C4 and/or C5 fractions, in addition to di-isobutene and/or tri-isobutene, to be evacuated in Stage b2) and/or in Stage c). These fractions, which comprise notable quantities of paraffins, have a lower reactivity for a supplementary oligomerization or for cracking.

With a complex feedstock, $C6^+$ oligomers ($Cn^+$ denoting hydrocarbons having at least n carbon atoms) can be sent to the cracking stage. If the feedstock of oligomers sent to cracking is to be reduced, just the $C8^+$ or even $C9^+$ fraction of oligomers can be sent to cracking. These variants can also be used in the case when an oligomerization is carried out in 1 stage, or in 2 stages b1 and b3). It is for example possible to carry out a first oligomerization b1) of a C4/C5 fraction, evacuate $C8^+$ oligomers to a fractionation zone for the preparation of bases of gasoline and/or of kerosene, feed the residual C4/C5 fraction to a second oligomerization b3), then separate second $C8^+$ or $C9^+$ oligomers, which are used as feed for cracking.

3) Catalytic Cracking (FCC):

The last stage of the complete and integrated variant of the process according to the invention is fluidized-bed catalytic cracking of the hydrocarbons leaving the oligomerization stage (or at least of a part of the oligomers formed), mixed with the main feedstock (typically of vacuum distillate), or separately and in parallel with said feedstock.

The FCC catalyst is typically used in the form of fine powder with average diameter often comprised between 40 and 140 μm, in particular between 50 and 120 μm. The preferred catalytic cracking catalysts are those that comprise at least one zeolite usually dispersed in a suitable matrix such as for example alumina, silica, or silica-alumina.

The zeolite most commonly used is zeolite Y, but some other zeolite can also be used advantageously, alone or mixed with zeolite Y. The catalyst can in particular comprise, in the process according to the invention, at least one zeolite exhibiting shape selectivity, said zeolite comprising silicon and at least one element selected from the group comprising aluminium, iron, gallium, phosphorus, boron, and preferably aluminium. The zeolite used, possessing shape selectivity, can be of one of the following structural types: MEL (for example ZSM-11), MH (for example ZSM-5), NES, EUO, FER, CHA (for example SAPO-34), MFS, MWW, or can also be one of the following zeolites: NU-85, NU-86, NU-88 and IM-5, which also exhibit shape selectivity.

The advantage of these zeolites which exhibit shape selectivity is that it leads to better propylene/isobutene selectivity (higher propylene/isobutene ratio in the effluents from cracking).

It is also possible to use several zeolites exhibiting shape selectivity, for example a zeolite of the MFI type (for example ZSM-5) combined with another zeolite exhibiting shape selectivity, previously mentioned or of one of the types previously mentioned.

The zeolite or zeolites exhibiting shape selectivity, from the group comprising zeolites of one of the following structural types: MEL (for example ZSM-11), MFI (for example ZSM-5), NES, EUO, FER, CHA (for example SAPO-34), MFS, MWW, or from the group of the following zeolites: NU-85, NU-86, NU-88 and IM-5, can also be mixed with a zeolite which does not exhibit shape selectivity, such as for example a zeolite Y of structural type FAU. The part of zeolite exhibiting shape selectivity relative to the total quantity of zeolite can vary as a function of the feedstocks used and the required range of products, as will be explained later. Often from 2 to 60 wt. %, in particular from 3 to 40 wt. %, and especially from 3 to 30 wt. % of zeolite(s) exhibiting shape selectivity is used.

The zeolite or zeolites can be dispersed in a matrix based on silica, alumina or silica-alumina, the part of zeolite (all zeolites combined) relative to the weight of the catalyst often being comprised between 3 and 80 wt. %, preferably between 4 and 50 wt. % and for example between 5 and 25 wt. %.

The zeolite exhibiting shape selectivity used (all zeolites exhibiting shape selectivity combined), which typically contains silicon and aluminium, generally has an Si/Al ratio greater than 12, preferably greater than 20, sometimes greater than 40 and even 80. A high Si/Al ratio makes it possible to reduce the acidity of the catalyst and the reactions of hydrogen transfer which lead to the formation of paraffins (including in the distillation range of gasoline) at the expense of the formation of propylene.

High Si/Al ratios can be obtained at the time of manufacture of the zeolite, or by subsequent dealumination.

The choice of type of catalyst and of zeolites used depends on various factors, including the feedstock used, the operating conditions, as well as the sought product range:

If maximum production of propylene is sought, even at the expense of the gasoline yield, a highly zeolitic catalyst will be chosen, having a high part of zeolite exhibiting shape selectivity (for example a type MFI zeolite such as ZSM-5), with a very high Si/Al ratio.

If, in contrast, in a particular economic situation, a high gasoline yield is sought, taking priority over the propylene yield, the zeolite which will be used will have a higher part of zeolite Y than in the preceding case, and a smaller or even zero part of zeolite exhibiting shape selectivity. Optionally, it will be possible to use a zeolite with an Si/Al ratio which as not as high. Finally, a lower operating temperature can be used.

Often, when aiming at a high level of propylene production, for example from 5 to 15 wt. % of the FCC feedstock, and simultaneously a relatively high production of gasoline, for example from 30 to 50 wt. % of the FCC feedstock, it can be preferable to use a catalyst comprising at least two zeolites, with for example a part of zeolite exhibiting shape selectivity between 2 and 40 wt. %, in particular between 3 and 30 wt. %, or between 4 and 20 wt. %, or for example between 5 and 15 wt. % relative to the total quantity of zeolites. Such a catalyst is then identical or relatively close to a conventional FCC catalyst.

The catalytic cracking catalyst can be different from the aforementioned catalysts, provided it possesses a notable activity in catalytic cracking for the production of propylene.

According to the invention, the two feedstocks (main and secondary) are cracked separately or as a mixture, typically at a temperature from approximately 450 to approximately 650° C. (temperature at reactor outlet), a pressure comprised between 0.1 and 0.5 MPa and residence times in the reactor of less than 1 minute, often from approximately 0.1 to approximately 50 seconds, and preferably from 0.1 to 10 seconds. If the relatively light secondary feedstock is cracked separately from the main feedstock, it can be cracked advantageously at a temperature higher than that used for the main feedstock.

The C/O ratio, which denotes the ratio of the mass flow of catalyst to the mass flow of inflowing feedstock, is generally between 4 and 7 and preferably between 4.5 and 6.5, said values not being limitative.

The main feedstock in catalytic cracking can be any type of feedstock used in catalytic cracking, i.e. most often a vacuum distillate or atmospheric residue. Said feedstock is, in the process according to the invention, typically cracked with conventional operating conditions which in particular make it possible to maintain the gasoline yield, or reduce this yield less, for a given production of propylene, as a part of the propylene formed comes from the cracking of oligomers.

In the case when the feedstock of the process also comprises an olefinic gasoline with olefins having a carbon number greater than five, or optionally greater than six (C6+ or C7+) olefins, the preferred point of introduction of these olefins is the catalytic cracking stage. It is also possible to use the olefins with C6 or even C7 or more as feed during oligomerization.

A catalytic cracking unit FCC is typically combined with a unit for separating the effluents which comprises primary separation of the effluents from the FCC, a section for compression and fractionation of the gases as well as distillation operations for fractionation of the various liquid fractions. This type of fractionation unit is well known to a person skilled in the art.

C4/C5 olefinic fractions or gasoline, for example a gasoline middle cut from FCC (for example a C7-C8 cut of relatively low octane number), can be recycled to oligomerization or to selective hydrogenation.

It is also possible to recycle only a part of the compounds which are present.

In particular, for the C4 cut, it is possible to extract the isobutene, for example by etherification of the isobutene with an alcohol then distillation, to avoid or limit its presence in the oligomerization stage, as this compound tends to form isomers which can be recracked to isobutene to a considerable extent in the FCC, which tends to cause an accumulation of this compound if a sufficient purge of isobutene is not carried out.

It is also possible, after extraction of the isobutene, to carry out an extractive distillation, for example with a solvent which can be N-methylpyrrolidone (NMP) or dimethylsulphoxide (DMSO) or an isomer of the latter, so as to extract the unsaturated fraction of paraffins from the feedstock which are mixed with the solvent. It is then possible for a mixture of butenes (and/or pentenes) devoid of C4 and/or C5 paraffins to be recycled to selective hydrogenation or to oligomerization. It is also possible to carry out similar fractionations on the feedstock upstream of the process, or after oligomerization.

The invention will be explained in more detail by means of the description of the attached FIGS. 1 to 4.

FIG. 1 shows an installation for implementing the process according to the invention in a first variant with considerable integration between the stages of the process (in particular by recycling):

A C4/C5 feedstock received from the steam cracking unit (not shown in the diagram) is introduced via line 1. Line 1 a supplies hydrogen or a hydrogen-rich gas which is used for the stage of selective hydrogenation carried out in a fixed bed in reactor(s) R1 (which can comprise 2 or 3 reaction zones (or even reactors) in series with intermediate cooling if required). The feedstock and the hydrogen-rich gas are introduced into the hydrogenation reactor R1 via line 2. The feed to R1 can also be a C4 and/or C5 olefinic recycling flow circulating in line 13. Reactor R1 is also fed by two separate lines 2 and 13 in FIG. 1. The feedstocks can also be fed as a mixture through a common line. Similarly, the hydrogen can be fed inside the reactor and not upstream of the latter. Such variant embodiments or equivalent technical means, obvious to a person skilled in the art, are also applicable to the other reactors or separation zones shown in FIGS. 1 to 4.

The effluents from reactor R1 feed, via line 3, a fractionation zone S1 comprising a stabilization column. It is also possible for any isobutene present in the feedstock and/or in a recycled fraction to be extracted at S1 (according to one of the techniques described hereafter or any other known techniques), to reduce the quantity or avoid the presence of isobutene in the oligomerization reactor. The light products, mainly hydrogen and methane, are evacuated through line 4. The selectively hydrogenated C4/C5 cut is introduced via line 5 into oligomerization reactor R2. A recycled olefinic cut, obtained from the effluents from the FCC, is optionally introduced via line 10 into the oligomerization reactor. Preferably, said cut can be returned to the selective hydrogenation stage via the aforementioned line 13, rather than to oligomerization. The effluents from oligomerization are extracted via line 6 and introduced into a separation zone S2. Zone S2 typically comprises a distillation of the effluents from oligomerization to recover the heavier oligomers, the residual C4/C5 cut, made up of a minor part of unconverted olefinic compounds and especially paraffinic compounds, being evacuated via line 7*a*. The oligomers are transferred at least partly via line 8, and introduced into the catalytic cracking reactor R3. Another part of these oligomers can be evacuated via line 7*c*. It is thus possible to reserve a part of these oligomers for uses other than the production of propylene, optionally for increased valorization. The production of propylene is then less, but the size of the cracking reactor is also reduced. As an example, it is possible to use a part of the C10-C14 oligomers as one of the bases for the manufacture of linear or non-linear alkylbenzenes, or as bases for other chemical or petrochemical applications. It is also possible to produce, starting from a part of the oligomers, fractions that boil in the distillation range of gasoline, kerosene gasoil, or domestic heating oil, which can be used as base(s) for the manufacture of these products. This evacuation of a part of the oligomers which are not used as feed for catalytic cracking is a notable advantage of the process according to the invention relative to single-stage processes for the conversion of light olefins to propylene, which cannot provide co-production of oligomers. It is also helps to remove isobutene indirectly, when said compound is present in the oligomerization feedstock: Said compound in fact tends to oligomerize easily but then undergo considerable recracking to isobutene, which therefore tends to accumulate when operating with total recycling of the light olefins received from catalytic cracking. The direct evacuation of a part of the oligomers, not used as feed for the FCC, therefore makes it possible to remove a part of the isobutene which has been oligomerized, and avoid its accumulation. This evacuation of a part of the oligomers, in particular of a fraction comprising di-isobutene and/or tri-isobutene, thus constitutes an indirect purge of isobutene.

An oligomeric fraction and/or C4 and/or C5 cut contained in the effluents from oligomerization can optionally be recycled to the oligomerization reactor R2 via line 7*b*, as this fraction, of very low reactivity, makes it possible to reduce the temperature rise in reactor R2 (or the reactors in series if the oligomerization comprises several reactors).

The feedstock of oligomers circulating in line 8 is cracked in fluidized-bed catalytic cracking (FCC) reactor R3. Reactor R3 is also fed with a main feedstock of vacuum distillate introduced via line 9.

The total feedstock of the catalytic cracking unit FCC therefore comprises mainly vacuum distillate, as well as an additional feedstock comprising oligomers of C4 and/or C5 olefins (or more generally from C2 to C10 or even more). It can also comprise another additional feedstock comprising gasoline, recycled via line 14.

The effluents from the FCC reactor R3 are evacuated via line 11 and are introduced into a separation zone S3.

Zone S3 typically comprises a gas compressor and distillation means. According to a first variant, a part at least of the isobutene is removed from the C4 cut before it is recycled (for example to selective hydrogenation or to oligomerization). Preferably said removal of isobutene is carried out after preliminary selective hydrogenation, separately or mixed with the fresh feedstock fed to line 1. In the latter case, the C4 (or C4/C5) cut from FCC is recycled via line 13 and hydrogenated selectively in reactor R1 as a mixture with the fresh feedstock.

The isobutene is for example separated (at S1 or S3) from the C4 or C4/C5 fraction that also comprises linear butenes, by a set of separation units, comprising for example etherification of the isobutene and optionally of other branched olefins with an alcohol, then distillation. It is also possible to carry out a hydroisomerization with reactive distillation, to separate the isobutene from the n-butenes (butene-1 being converted to butene-2 which can be separated from isobutene).

For extraction of branched olefins (isobutene and/or isoamylenes) upstream of oligomerization, use of one or more known processes of separation, such as liquid-liquid extractions, etherifications, or other processes such as membrane processes or use of selective adsorbants optionally in simulated countercurrent, also falls within the scope of the invention.

It is also possible to optionally recycle a part or the whole of the C5 cut from FCC via line 13, or optionally heavier fractions in particular with C6 and/or C7 and/or C8.

The unrecycled effluents from the FCC are evacuated via line 12, as well as via other lines which are not shown. A part or the whole of the C4 cut contained in the effluents from cracking can also be evacuated, and not recycled.

According to another variant, the C4 or C4/C5 cut can be recycled without extracting the isobutene. The raw C4 or C4/C5 feedstock, after selective hydrogenation, is then oligomerized in R2 and separated in S2. S2 can then comprise just a separation of the oligomers (by distillation), sent to reactor R3 via line 8, with the residual C4 or C4/C5 cut (contained in the oligomerization effluents), essentially paraffinic, being evacuated via line 7*a*. It is then preferable, to avoid accumulation of isobutene in the plant, to provide an evacuation (without recycling) of a part of the C4 cut obtained from cracking, and/or not feed a part of the oligomers comprising di-isobutene and/or tri-isobutene to the cracking stage, so as to achieve a direct or indirect purge of isobutene.

It is also possible to recycle C5 or even C6 olefinic fractions, or the ethylene produced by the FCC.

The following examples illustrate the invention without limiting its scope. All the yields were obtained on pilot-plant units with operating conditions representative of those of industrial units.

EXAMPLE 1

According to the State of the Art

A feedstock, namely a vacuum distillate with the following main characteristics:

| | |
|---|---|
| Density | 0.93 |
| Viscosity (cSt) | 9 |
| Conradson carbon | 1.1 |
| TBP 10% (° C.) | 360 |
| TBP 90% (° C.) | 560 |

is treated in a catalytic cracking unit of the FCC type operating in the conditions specified below.

The operating conditions of the FCC are as follows:

Temperature at riser outlet: 510° C.

C/O ratio (by mass): 5 to 6

Regeneration temperature: 700° C.

Pressure in the reaction zone: 0.2 MPa

Catalyst: 95 wt. % of zeolite Y type of catalyst dispersed in a matrix, and 5 wt. % of the type ZSM-5 catalyst dispersed in a matrix.

Average diameter of the catalyst: 70 μm

Particle density: 1250 kg/m$^3$

The propylene yield relative to the feedstock is 3.2 wt. %.

The gasoline yield relative to the feedstock is 42.8 wt. %.

EXAMPLE 2

According to the Invention

Figure 1:
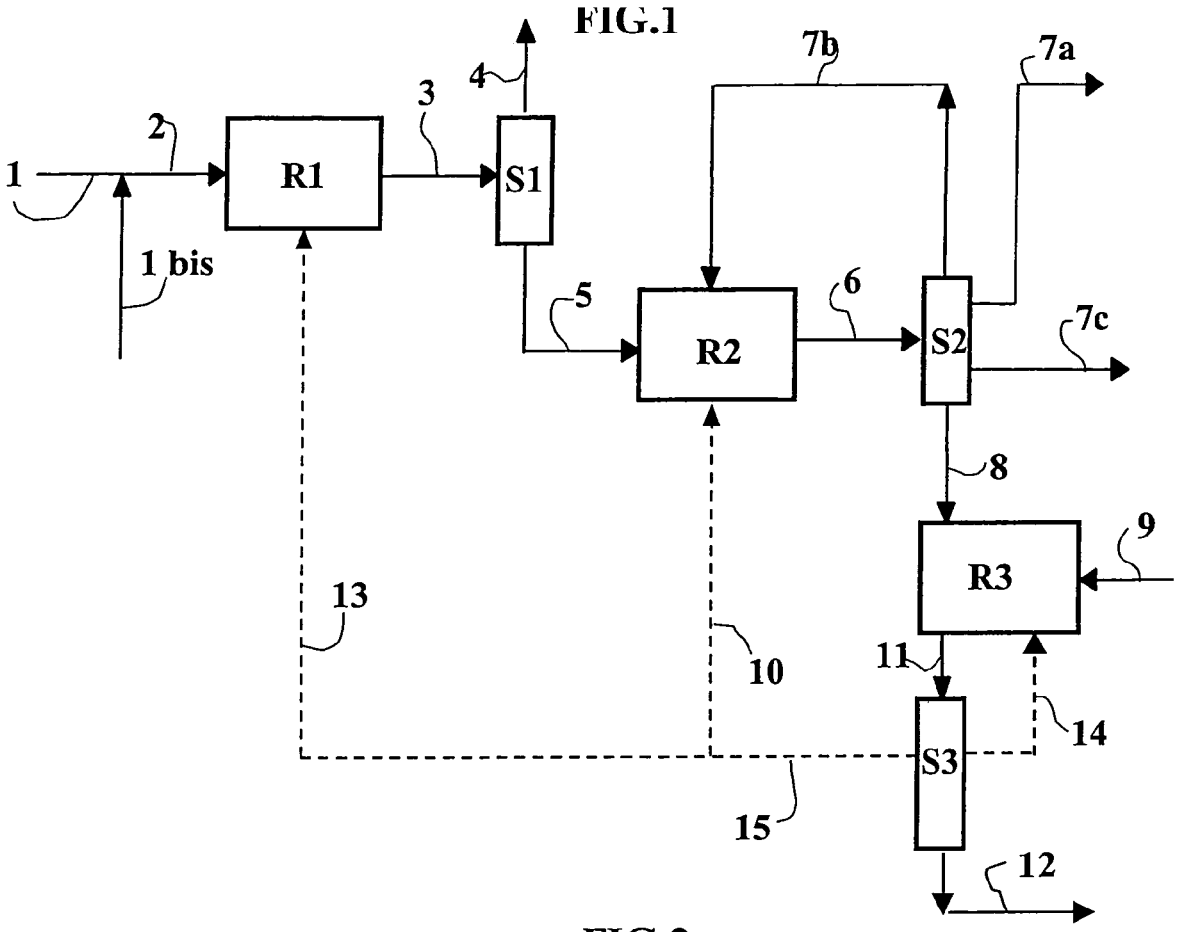

A C5 cut from a steam cracker, comprising mostly butadiene, is treated according to the process of the present invention in an installation such as that described in FIG. 1. Said C4 cut is hydrogenated selectively in R1 and the light compounds, in particular the residual hydrogen and the light gases such as methane are removed in the separation section S1. The C4 cut resulting from this hydrogenation (flow 5) is introduced into the oligomerization reactor R2 which operates in the following conditions:

| | |
|---|---|
| Pressure: | 5.5 MPa |
| Temperature: | 220° C. |
| HSV: | 1 h$^{-1}$ |

The catalyst used is a type MFI zeolite with an Si/Al ratio of 48. It is used in the form of spheres with average diameter of 2 mm.

The flow leaving oligomerization contains 90% of oligomers relative to the olefins of the feedstock, mainly C8 olefinic oligomers, in smaller quantities of C12.

The quantity of oligomers introduced in catalytic cracking represents 10 wt. % of the total feedstock. These oligomers, after fractionation in section S2, are introduced into the catalytic cracking unit (FCC), mixed with the same feedstock of vacuum distillate as that in Example 1. The FCC operates with the same operating conditions as those of Example 1. The residual C4 olefinics separated in section S2 are recycled to the oligomerization reactor R2.

The propylene yield relative to the vacuum distillate feedstock plus the oligomeric feedstock entering the FCC is 5.6% and the gasoline yield is 40.6%.

EXAMPLE 3

According to the Invention, Shown in FIG. 1

A C4 cut obtained from a steam cracker is treated according to the process of the present invention. This is a cut of the same kind as that used in Example 2, but the quantity of oligomers introduced in the catalytic cracking stage at present represents 18% of the catalytic cracking feedstock. The operating conditions of the oligomerization reactor and of the FCC reactor are the same as in Example 2. The propylene yield is 7.6% and the gasoline yield is 38.9%.

EXAMPLE 4

According to the Invention, Shown in FIG. 1

The same C4 cut as that used in Examples 2 and 3 is treated according to the process of the present invention. The quantity of oligomers from the fresh external feedstock (from oligomerization of the steam cracked cut) introduced in the catalytic cracking stage represents 10% of the catalytic cracking feedstock. The oligomerization stage still operates with the conditions of Examples 2 and 3. The catalytic cracking still operates in the conditions of Example 1. In this Example 4, the C4 cut from the catalytic cracking stage is recycled to the oligomerization stage, to increase the quantity of cracked oligomers.

The propylene yield is 8.3% and the gasoline yield is 42.7%.

EXAMPLE 5

Figure 2:
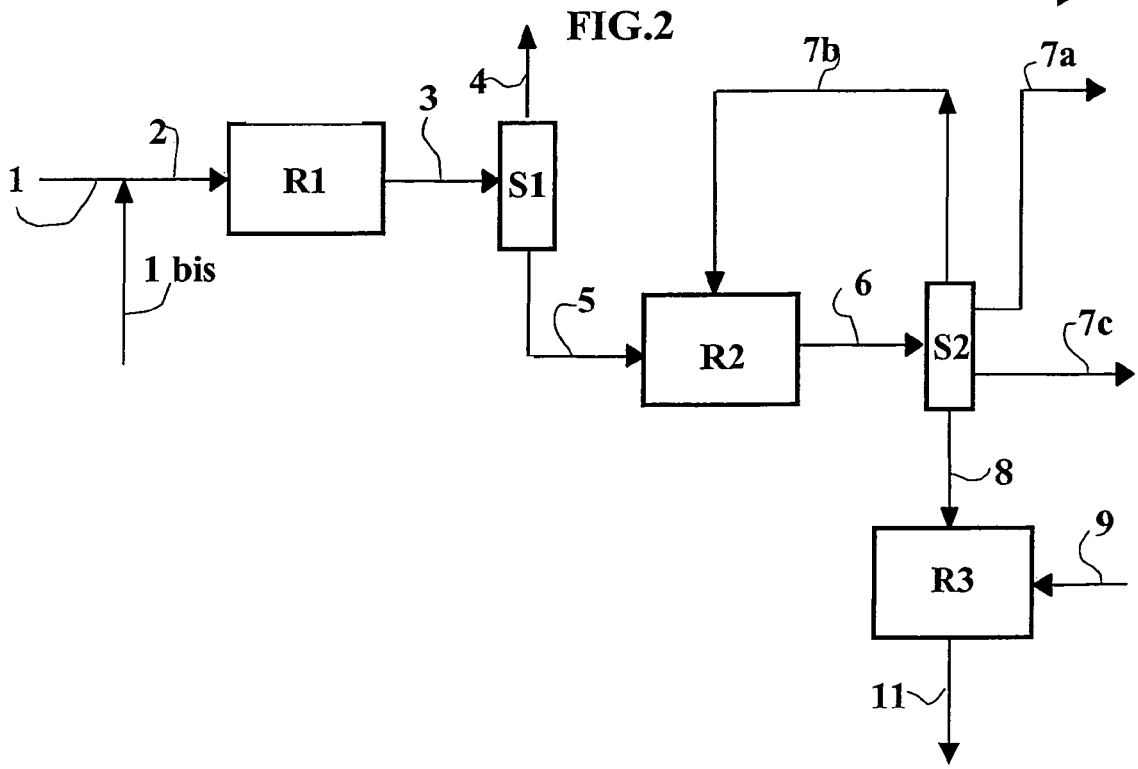
FIG. 2 shows a variant of the process which does not include the recycling of a C4 or C4/C5 olefinic cut to oligomerization.

According to the Invention, Shown in FIG. 2

This example is similar to Example 4, but the quantity of oligomers coming from the fresh external feedstock which are introduced in the catalytic cracking stage represents 22% of the main vacuum distillate feedstock of catalytic cracking. The propylene yield is 11.1% and the gasoline yield is 41.6%.

EXAMPLE 6

According to the Invention

Figure 3:
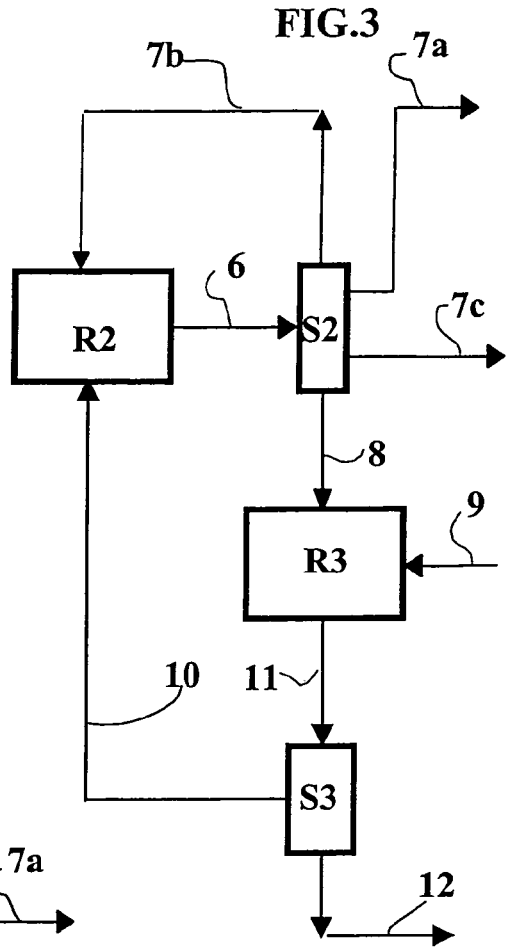
FIG. 3 shows another variant of the process which does not include feed of olefinic feedstock by a C4 cut obtained from a steam cracker, but only includes feed of the FCC with a feedstock of vacuum distillate or of atmospheric residue, and recycling of the C4 or C4/C5 olefinic cut to the oligomerization reactor.
Figure 4:
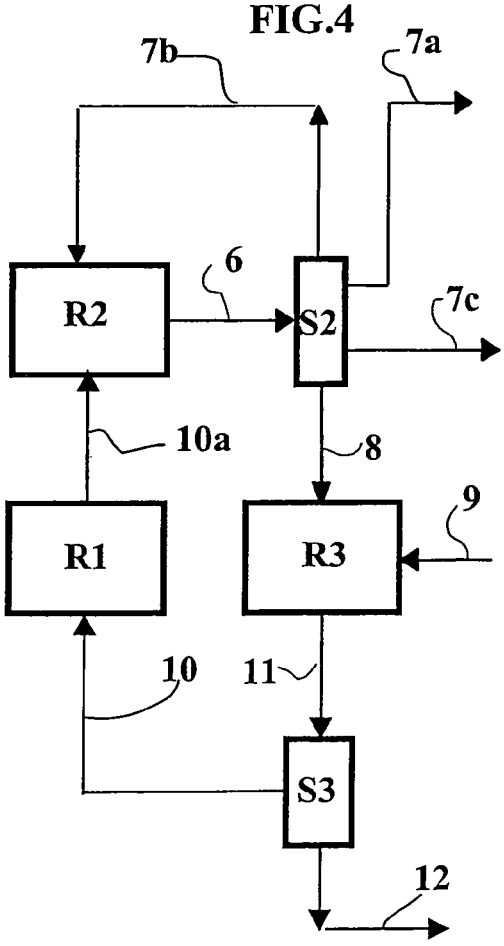
FIG. 4 shows a variant similar to that in FIG. 3, but with a stage of selective hydrogenation of the C4 or C4/C5 olefinic cut prior to its recycling to the oligomerization reactor.

Example 6 illustrates a mode of operation according to the invention, of an installation such as that described in FIG. 3, wherein only recycling of the linear olefins of the C4 cut obtained from the catalytic cracking stage is used as the feedstock of the oligomerization unit.

The propylene yield relative to the total feedstock of vacuum distillate+oligomers entering the FCC is 5% and the gasoline yield is 44.1%.

EXAMPLE 7

According to the Invention

This example is similar to Example 6, except that the C4 and C5 linear olefins obtained from the FCC are recycled to the oligomerization stage.

The propylene yield is 7.1% and the gasoline yield is 40.6%.

The synoptic table given below shows that the propylene yield is still greater than that of catalytic cracking operating on a vacuum distillate feedstock, whatever configuration is adopted. This propylene yield increases with the quantity of oligomers introduced into the FCC.

Examples 6 and 7 illustrate the possibility of using the process without C4 feedstock obtained from steam cracking, simply by recycling the C4 olefinic fraction and/or the C5 olefinic cut obtained from the FCC. The external feedstock is then only the vacuum distillate, used as feed for the FCC.

These examples illustrate the great flexibility of the process in terms of propylene yield and show that it is possible to reach a propylene yield exceeding 10%, while maintaining an excellent level of production of gasoline which is still close to 40% or even greater than 40% for all of the examples given. These propylene and gasoline yields are moreover calculated relative to the total feedstock feeding the FCC (vacuum distillate+oligomers). If these yields were calculated relative to the vacuum distillate main feedstock alone, higher figures would be obtained.

TABLE 1

| Example No. | Vacuum distillate flow rate | Flow rate of C4 cut from steam cracking | Flow rate of recycled C4 cut ex FCC | Gasoline yield wt. %/ FCC total feedstock | Propylene yield wt. %/ FCC total feedstock |
|---|---|---|---|---|---|
| 1 | 100 | 0 | 0 | 42.8 | 3.2 |
| 2 | 100 | 11 | 0 | 41.6 | 5.6 |
| 3 | 100 | 22 | 0 | 40.2 | 7.6 |
| 4 | 100 | 11 | 10.2 | 42.7 | 8.3 |
| 5 | 100 | 22 | 14.5 | 41.6 | 11.1 |

| Example No. | Vacuum distillate flow rate | Flow rate of recycled C4 cut - FCC | Flow rate of recycled C5 cut - FCC | Gasoline yield wt. %/ FCC total feedstock | Propylene yield wt. %/ FCC total feedstock |
|---|---|---|---|---|---|
| 6 | 100 | 6.1 | 0 | 43.1 | 5 |
| 7 | 100 | 8.3 | 5 | 40.6 | 7.1 |

The invention claimed is:

1. A process for conversion of a hydrocarbon feedstock comprising at least one relatively heavy main feedstock comprising hydrocarbons with a boiling point above approximately 350° C., and at least one relatively light secondary feedstock comprising hydrocarbons with a boiling point below approximately 320° C., wherein, said relatively heavy main feedstock, representing at least 50 wt. % of said hydrocarbon feedstock, is cracked in at least one fluidized-bed catalytic cracking reactor in the presence of a cracking catalyst, said relatively light secondary feedstock is cracked in a fluidized bed with the same cracking catalyst, separately or mixed with said main feedstock, said secondary feedstock comprising olefins with at least 8 carbon atoms which were produced in at least one stage of oligomerization of a feedstock comprising light olefins with 4 and/or 5 carbon atoms, followed by a fractionation stage to separate a part at least of the oligomerization effluent, which part is evacuated directly without feeding the catalytic cracking reactor, said evacuated part comprising at least a part of the oligomers produced, said part comprising di-isobutene and/or tri-isobutene, effluents from cracking of the main feedstock and of the secondary feedstock are fractionated in a common fractionation zone, and the catalyst used for cracking the main feedstock and that used for cracking the secondary feedstock are regenerated in a common regeneration zone, to produce at least gasoline and propylene, separating the gasoline, and wherein at least a part of said evacuated fraction comprising di-isobutene is added to at least a part of the gasoline produced directly by cracking, to produce a gasoline base.

2. A process according to claim 1, wherein the main feedstock and the secondary feedstock are cracked as a mixture in the fluidized-bed catalytic cracking reactor FCC.

3. A process according to claim 1, comprising conducting a preliminary step of subjecting a stream, a feedstock comprising olefins with 4 and/or 5 carbon atoms to oligomerization in at least one stage, in at least one oligomerization reactor, to produce an effluent comprising a part at least of the olefins with at least 8 carbon atoms and passing at least part of said stream, as the secondary feedstock to said catalytic cracking.

4. A process according to claim 1, wherein:

effluent from said catalytic cracking reactor is fractionated to produce a cut comprising olefins with 4 and/or 5 carbon atoms, and a part at least of said cut is recycled to oligomerization.

5. A process according to claim 1, wherein feedstock to the oligomerization stage comprises from 0.5 to 15 wt. % of ethylene.

6. A process according to claim 1, wherein the feedstock to the oligomerization reactor comprises from 0.5 to 15 wt. % of ethylene relative to the total of the C4, C5 and C6 olefins.

7. A process according to claim 1, wherein the feedstock to the oligomerization reactor comprises at least 50 wt. % of C4+C5+C6 hydrocarbons, at least 10 wt. % of olefins with 4 carbon atoms, as well as olefins with 5 and/or 6 carbon atoms, with a mass ratio [R1=(C5 olefins+C6 olefins)/C4 olefins] greater than 0.15.

8. A process according to claim 1, wherein the feedstock to the oligomerization reactor comprises at least 50 wt. % of C4+C5+C6 hydrocarbons, at least 10 wt. % of olefins with 4 carbon atoms, as well as olefins with 5 carbon atoms, with a mass ratio [R2=C5 olefins/C4 olefins] greater than 0.15.

9. A process according to claim 1, wherein the feedstock to the oligomerization stage comprises diolefinic and/or acetylenic compounds, and wherein said feedstock is subjected beforehand to a Stage a) of selective hydrogenation so that said diolefinic and/or acetylenic compounds are practically eliminated.

10. A process according to claim 1, comprising:

a first stage of limited oligomerization b1), a Stage b2) of fractionation of the effluents from Stage b1), to produce at least one fraction which is evacuated directly without feeding the subsequent stages, said evacuated fraction comprising di-isobutene, a Stage b3) of final oligomerization of the effluent from Stage b2) or at least of C4 and/or C5 olefinic fractions contained in said effluent, after evacuation of the aforementioned cut comprising di-isobutene.

11. A process according to claim 10, wherein the following are carried out:

Stage b1) with a feedstock comprising essentially a C4 cut only,

Stage b3) by adding a C5 or C2+C5 cut to the butenes not converted in b1).

12. A process according to claim 1, wherein the conditions of the oligomerization stage are determined, by limiting the conversion, for which said evacuated cut (or part) comprising di-isobutene makes it possible, after at least partial addition to at least a part of the gasoline produced directly by cracking, to increase at least the motor octane number or research octane number of said cracked gasoline.

13. A process according to claim 1, wherein the oligomerization reactor contains a catalyst comprising a zeolite or a silica-alumina operating at a temperature comprised between 70° C. and 310° C., a pressure comprised between 0.1 and 5 MPa, and a space velocity comprised between 0.1 and 5 $m^3$ per hour per $m^3$ of catalyst.

14. A process according to claim 1, wherein the catalyst used for catalytic cracking comprises a zeolite exhib1ting shape selectivity of structural type MFI, alone or mixed with another zeolite exhibiting shape selectivity selected from zeolites of one of the following structural types: MEL, NES, EUO, FER, CHA, MFS, MWW, or the following group of zeolites: NU-85, NU-86, NU-88 and IM-5, and wherein said zeolite or zeolites exhib1ting shape selectivity have an Si/Al ratio greater than 12.

15. A process according to claim 1, wherein the relatively heavy main feedstock is cracked in a first substantially vertical tubular riser and the relatively light secondary feedstock is cracked separately in a second substantially vertical tubular riser.

16. A process according to claim 1, wherein the relatively heavy main feedstock and the relatively light secondary feedstock are cracked as a mixture in the same substantially vertical tubular riser.

17. A process according to claim 1, wherein the heavy main feedstock comprises a vacuum distillate.

18. A process for conversion of a hydrocarbon feedstock comprising at least one relatively heavy main feedstock comprising hydrocarbons with a boiling point above approximately 350° C., and at least one relatively light secondary feedstock comprising hydrocarbons with a boiling point below approximately 320° C., wherein, said relatively main feedstock, representing at least 50 wt. % of said hydrocarbon feedstock, is cracked in at least one fluidized-bed catalytic cracking reactor in the presence of a cracking catalyst, said relatively light secondary feedstock is cracked in a fluidized bed with the same cracking catalyst, separately or mixed with said main feedstock, said secondary feedstock comprising olefins with at least 8 carbon atoms which were produced by multistage oligiomerization comprising a first stage b1) of limited oligomerization, with a feedstock comprising essentially a C4 cut only;

Stage b1) with a feedstock comprising essentially a C4 cut only;

Stage b3) by adding a C5 or C2+C5 cut to the butenes not convened in b1);

a stage b3), adding a C5 or C2+C5 cut to butenes not convened in b1) and oligomerizing the resultant mixture;

said cracking of the relatively heavy feedstock and the relatively light feedstock resulting in effluent comprising gasoline and propylene.

19. A process for conversion of a hydrocarbon feedstock comprising at least one relatively heavy main feedstock comprising hydrocarbons with a boiling point above approximately 350° C., and at least one relatively light secondary feedstock comprising hydrocarbons with a boiling point below approximately 320° C., wherein, said relatively main feedstock, representing at least 50 wt. % of said hydrocarbon feedstock, is cracked in at least one fluidized-bed catalytic cracking reactor in the presence of a cracking catalyst, said relatively light secondary feedstock is cracked in a fluidized bed with the same cracking catalyst, separately or mixed with said main feedstock, said secondary feedstock comprising olefins with at least 8 carbon atoms which were produced by in at least one stage of oligomerization of a feedstock comprising light olefins with 4 and/or 5 carbon atoms, followed by a fractionation stage to separate a pan at least of the oligomerization effluent, which part is evacuated directly without feeding the catalytic cracking reactor, said evacuated part comprising at least a part of the oligomers produced, said part comprising diisobutene and/or tri-isobutene, withdrawing effluent from the fluidized bed cracking reactor(s) at least gasoline and propylene, separating the gasoline, and adding at least a part of said evacuated fraction comprising di-isobutene is added to a part at least of the gasoline produced directly by cracking, to produce a gasoline base.

* * * * *

UNITED STATES PATENT AND TRADEMARK OFFICE

CERTIFICATE OF CORRECTION

PATENT NO. : 7,374,662 B2
APPLICATION NO. : 10/507847
DATED : May 20, 2008
INVENTOR(S) : Jean-Luc Duplan It is certified that error appears in the above-identified patent and that said Letters Patent is hereby corrected as shown below:

Column 22, line 43 reads "effluent from said catalytic cracking reactor is fractionated" should read --the effluent from said catalytic cracking reactor is fractionated--
Column 23, line 34 reads "exhib l ting" should read --exhibiting--
Column 23, line 40 reads "exhib l ting" should read --exhibiting--
Column 24, line 18 reads "convened" should read --converted--
Column 24, line 20 reads "convened" should read --converted--
Column 24, line 43 reads "pan" should read --part--

Signed and Sealed this

Twenty-sixth Day of August, 2008

JON W. DUDAS
*Director of the United States Patent and Trademark Office*